US009903600B2

(12) United States Patent
Ozaki et al.

(10) Patent No.: US 9,903,600 B2
(45) Date of Patent: Feb. 27, 2018

(54) WIND DIRECTION ADJUSTING DEVICE OF AIR-CONDITIONING APPARATUS AND AIR-CONDITIONING APPARATUS

(71) Applicant: Mitsubishi Electric Corporation, Tokyo (JP)

(72) Inventors: Den Ozaki, Tokyo (JP); Kazuhito Kojima, Tokyo (JP); Yasushi Oba, Tokyo (JP); Hiroshi Omura, Tokyo (JP); Shota Sugai, Tokyo (JP); Takuya Niimura, Tokyo (JP); Yosuke Naito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 366 days.

(21) Appl. No.: 14/663,958

(22) Filed: Mar. 20, 2015

(65) Prior Publication Data

US 2015/0338124 A1 Nov. 26, 2015

(30) Foreign Application Priority Data

May 21, 2014 (JP) ..... 2014-105090

(51) Int. Cl.
*F24F 1/00* (2011.01)
*F24F 13/14* (2006.01)

(52) U.S. Cl.
CPC ..... *F24F 1/0011* (2013.01); *F24F 13/1413* (2013.01); *F24F 13/1426* (2013.01); *F24F 13/1486* (2013.01); *F24F 2013/1473* (2013.01)

(58) Field of Classification Search
CPC .. F24F 1/0011; F24F 13/1413; F24F 13/1426; F24F 13/1486

(Continued)

(56) References Cited

U.S. PATENT DOCUMENTS 2,552,982 A * 5/1951 Lambert ..... F24F 13/075 454/319
3,701,311 A * 10/1972 McLarty ..... B60H 1/3428 454/319

(Continued)

FOREIGN PATENT DOCUMENTS

CN 1236881 A 12/1999
JP 09-196457 A 7/1997

OTHER PUBLICATIONS

Extended European Search Report dated Jan. 7, 2016 in the corresponding EP application No. 15163374.0.

(Continued)

*Primary Examiner* — Steven B McAllister
*Assistant Examiner* — Allen Schult
(74) *Attorney, Agent, or Firm* — Posz Law Group, PLC

(57) ABSTRACT

An air flow direction adjusting device of an air-conditioning apparatus includes: a base member including attachment shafts; air flow direction adjusting members individually attached to the attachment shafts such that the air flow direction adjusting members are allowed to rotate; and a link plate configured to rotate the air flow direction adjusting members in an interlocked manner. At least one of the air flow direction adjusting members includes a rotation shaft attachment portion attached to the corresponding one of the attachment shafts, a link plate engagement portion to be engaged with the link plate, and an operation member attachment portion to which a manual operation member for manually adjusting orientation of the air flow direction adjusting members is attached. The manual operation member is not attached to at least one of the air flow direction adjusting members.

7 Claims, 13 Drawing Sheets

(58) Field of Classification Search
USPC ..... 454/314
See application file for complete search history.

(56) References Cited

U.S. PATENT DOCUMENTS 5,176,571 A * 1/1993 Fujihara ..... B60H 1/3421 454/285
5,338,252 A * 8/1994 Bowler ..... B60H 1/3421 454/155
5,364,303 A * 11/1994 Terry ..... B60H 1/345 454/155
5,470,276 A * 11/1995 Burnell ..... F24F 13/075 454/155
5,586,935 A * 12/1996 Kotoh ..... F16K 1/165 454/285
5,626,517 A * 5/1997 Kil ..... F24F 1/0011 454/315
5,690,550 A * 11/1997 Mikowski ..... B60H 1/345 454/155
6,059,653 A * 5/2000 Gehring ..... B60H 1/3428 454/155
6,113,487 A * 9/2000 Kim ..... F24F 1/027 454/202

OTHER PUBLICATIONS

Office Action dated Jul. 25, 2017 issued in corresponding CN patent application No. 201510263791.1 (and English translation).

* cited by examiner

WIND DIRECTION ADJUSTING DEVICE OF AIR-CONDITIONING APPARATUS AND AIR-CONDITIONING APPARATUS

TECHNICAL FIELD

The present invention relates to an air flow direction adjusting device of an air-conditioning apparatuses and an air-conditioning apparatus.

BACKGROUND ART

A known air flow direction adjusting device includes a plurality of air flow direction adjusting members disposed at an air outlet of an air-conditioning apparatus so as to change the direction of air flow blowing from the air outlet of the air-conditioning apparatus. For example, an air flow direction adjusting device of Patent Literature 1 includes an air flow direction adjusting member with a movable operation unit and an air flow direction adjusting member with no movable operation unit. Orientations of these air flow direction adjusting members are adjusted by operating the movable operation unit, and thereby, the direction of air blowing from the air outlet of the air-conditioning apparatus is adjusted.

CITATION LIST

Patent Literature

[Patent Literature 1] Japanese Unexamined Patent Application Publication No. 9-196457 (page 4, FIG. 1)

SUMMARY OF INVENTION

Technical Problem

However, since the air flow direction adjusting device of Patent Literature 1 includes the air flow direction adjusting member with the movable operation unit and the air flow direction adjusting member with no movable operation unit, and these air flow direction adjusting members have different structures, manufacturing and assembly processes are complex, and an increased burden is placed on managing components. In the assembly process, for example, it is necessary to determine the part to which a selected one of the air flow direction adjusting members is to be attached. Consequently, the manufacturing process is complicated.

The present invention has been made in view of problems as described above. It is an object of the present invention to provide an air flow direction adjusting device of an air-conditioning apparatus including commonalizes air flow direction adjusting members so that a manufacturing process and an assembly process are simplified and the burden placed on managing components is reduced.

Solution to Problem

An air flow direction adjusting device of an air-conditioning apparatus according to the present invention includes: a base member including a plurality of attachment shafts projecting from an air passage surface forming an air passage of the air-conditioning apparatus; a plurality of air flow direction adjusting members individually attached to the attachment shafts such that the plurality of air flow direction adjusting members are allowed to rotate; and a link plate configured to connect the plurality of air flow direction adjusting members to one another such that the plurality of air flow direction adjusting members rotate in an interlocked manner, wherein at least one of the plurality of air flow direction adjusting members includes a rotation shaft attachment portion attached to the corresponding one of the attachment shafts, a link plate engagement portion engaged with the link plate, and an operation member attachment portion to which a manual operation member for manually adjusting orientation of the air flow direction adjusting members is attached, and the manual operation member is not attached to at least one of the plurality of air flow direction adjusting members.

Advantageous Effects of Invention

Since the air flow direction adjusting device of the air-conditioning apparatus of the present invention includes commonalized the air flow direction adjusting members, the manufacturing processes and the assembly process are simplified and the load of managing the components is reduced.

DESCRIPTION OF EMBODIMENTS

Figure 1:
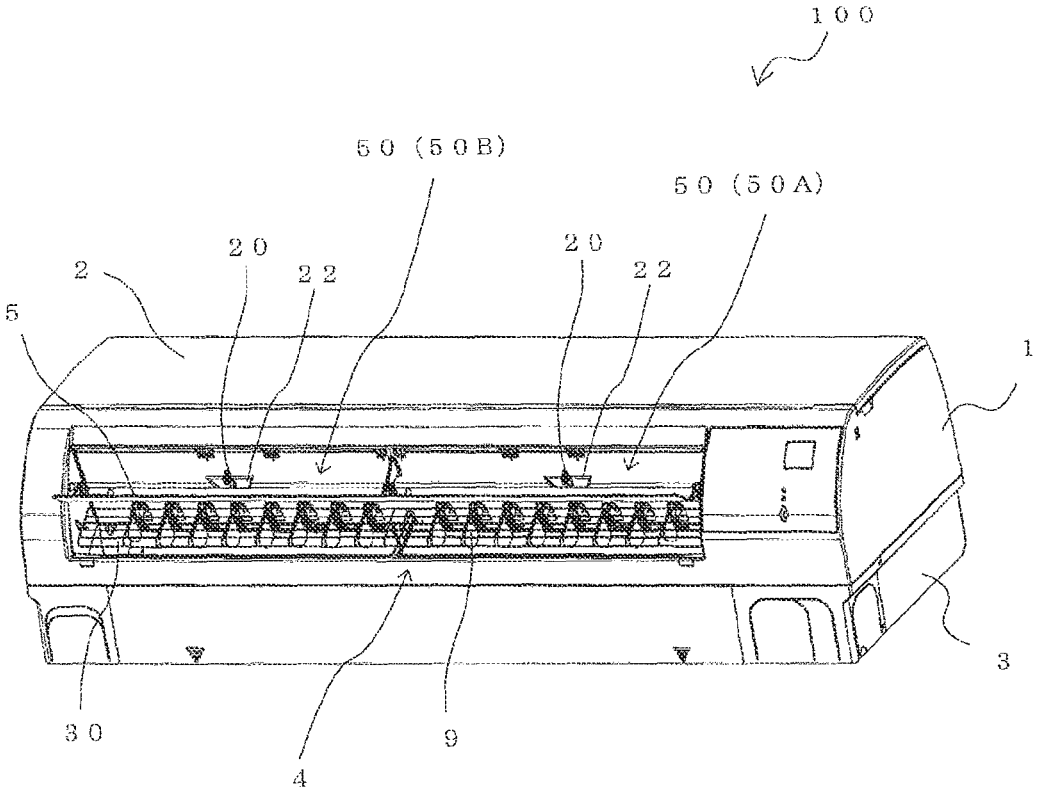
FIG. 1 is a perspective view illustrating an indoor unit of an air-conditioning apparatus according to Embodiment 1 of the present invention.

Embodiments of the present invention will be described with reference to the drawings. In the drawings, like reference numerals refer to like elements, and description thereof is not repeated or is simplified. The dimensions and locations of components illustrated in the drawings can be appropriately modified within the scope of the invention.

Embodiment 1

Figure 2:
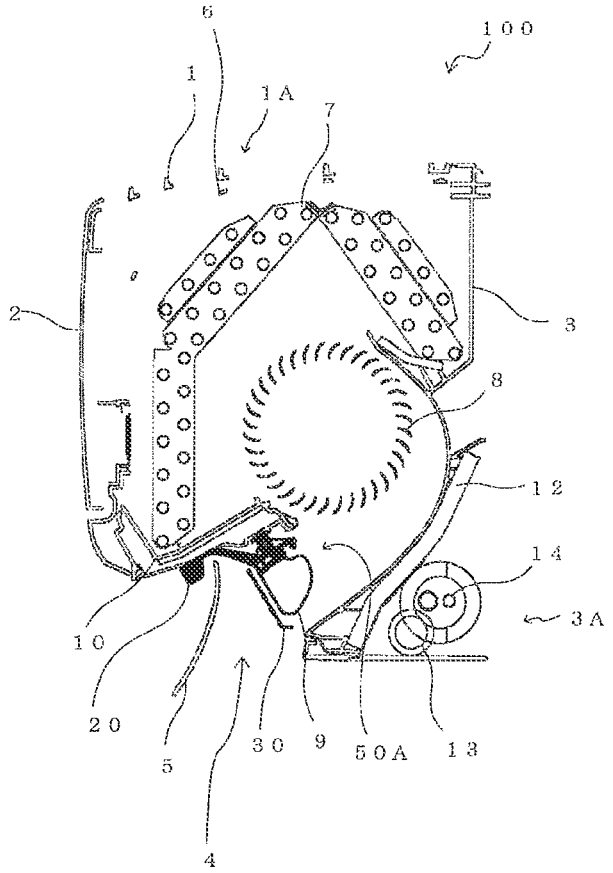
FIG. 2 is a vertical cross-sectional view schematically illustrating a vertical cross section of the indoor unit illustrated in FIG. 1.

FIG. 1 is a perspective view illustrating an indoor unit 100 of an air-conditioning apparatus according to Embodiment 1 of the invention. FIG. 2 is a vertical cross-sectional view schematically illustrating a vertical cross section of the indoor unit 100 illustrated in FIG. 1. The indoor unit 100 of Embodiment 1 is installed on, for example, the wall of a room in order to cool or heat the inside of the room.

The indoor unit 100 includes a front casing 1 and a rear casing 3. The rear casing 3 is attached to an installation member (not shown) fixed to the wall, a pole, or the like, and supports the entire indoor unit 100. The front casing 1 is attached to the rear casing 3, and a front design panel 2 is attached to the front surface of the front casing 1 so as to cover the front surface of the indoor unit 100 such that the front design panel 2 can be freely opened and closed. The front design panel 2 is attached to the front casing 1 such that the front design panel 2 can freely rotate.

As illustrated in FIG. 2, in the indoor unit 100, a filter 6, a heat exchanger 7, a fan 8, and a drain pan 10, for example, are housed in an internal space covered with the front casing 1 and the rear casing 3. The fan 8 draws in air from the room through an air inlet 1A formed in an upper portion of the front casing 1, and blows out air into the room through an air outlet 4 formed in a lower portion of the front surface of the front casing 1.

The filter 6 is disposed between the air inlet 1A and the heat exchanger 7 and is used to remove dust or the like contained in air drawn in through the air inlet 1A. The heat exchanger 7 is disposed between the air inlet 1A and the air outlet 4 and performs heat exchange with air drawn in the air inlet 1A. Air subjected to heat exchange in the heat exchanger 7 blows out from the air outlet 4. The drain pan 10 is disposed below the heat exchanger 7 near the front design panel 2 of the heat exchanger 7, for example, and is used to receive condensed water dripping from the heat exchanger 7.

At the rear of the rear casing 3, a storage space 3A is disposed outside the indoor unit 100. In the storage space 3A, a heat insulator 12 is disposed inside the indoor unit 100, and a drain hose 13, a pipe 14, and a power cord (not shown), for example, are disposed between the storage space 3A and the inside of the indoor unit 100 with a heat insulator 12 interposed therebetween.

At the air outlet 4, a vertical air flow direction adjusting device 5 for adjusting the direction of air flow vertically and an air flow direction adjusting device 50 for adjusting the direction of air flow laterally are disposed. A protective cover 30 is disposed over the front surface of the air flow direction adjusting device 50 such that it does not inhibit rotation of air flow direction adjusting members 9 of the air flow direction adjusting device 50.

As illustrated in FIG. 1, the air flow direction adjusting device 50 of Embodiment 1 includes an air flow direction adjusting device 50A on the left of the inside of the air outlet 4 and an air flow direction adjusting device 50B on the right of the inside of the air outlet 4. Each of the air flow direction adjusting device 50A and the air flow direction adjusting device 50B includes a manual operation member 20 housed in a housing 22. A user operates the manual operation member 20, causes the air flow direction adjusting members 9 to rotate, and adjusts the direction of air blowing from the air outlet 4. The air flow direction adjusting device 50A and the air flow direction adjusting device 50B have similar configurations, and thus, the following description is directed only at the air flow direction adjusting device 50A, and detailed description of the air flow direction adjusting device 50B is omitted.

Figure 3:
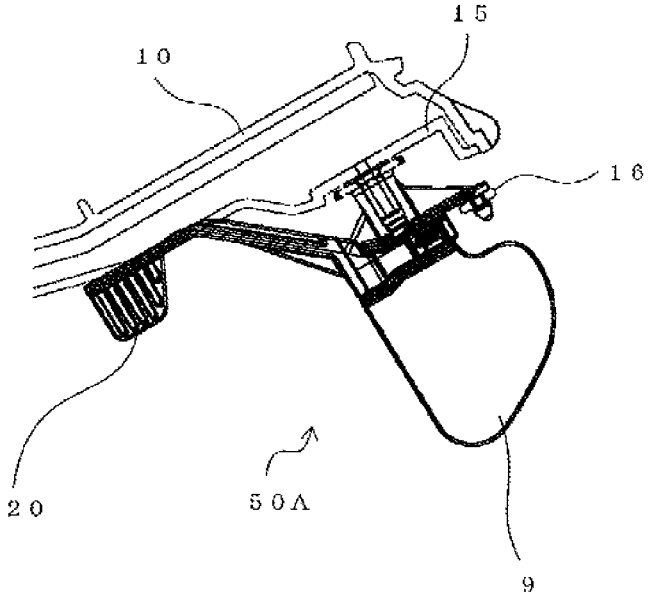
FIG. 3 is an enlarged view illustrating part of an air flow direction adjusting device shown in FIG. 2 in an enlarged manner.

FIG. 3 is an enlarged view illustrating part of the air flow direction adjusting device 50A shown in FIG. 2. As illustrated in FIG. 3, the air flow direction adjusting device 50A includes a base member 15, air flow direction adjusting members 9, a link plate 16, and a manual operation member 20. The base member 15 is located below the drain pan 10. The base member 15 is composed of, for example, components different from the front casing 1 and the drain pan 10, and is fixed to the front casing 1 or the drain pan 10. The base member 15 may be integrated with the front casing 1 or the drain pan 10.

Figure 8:
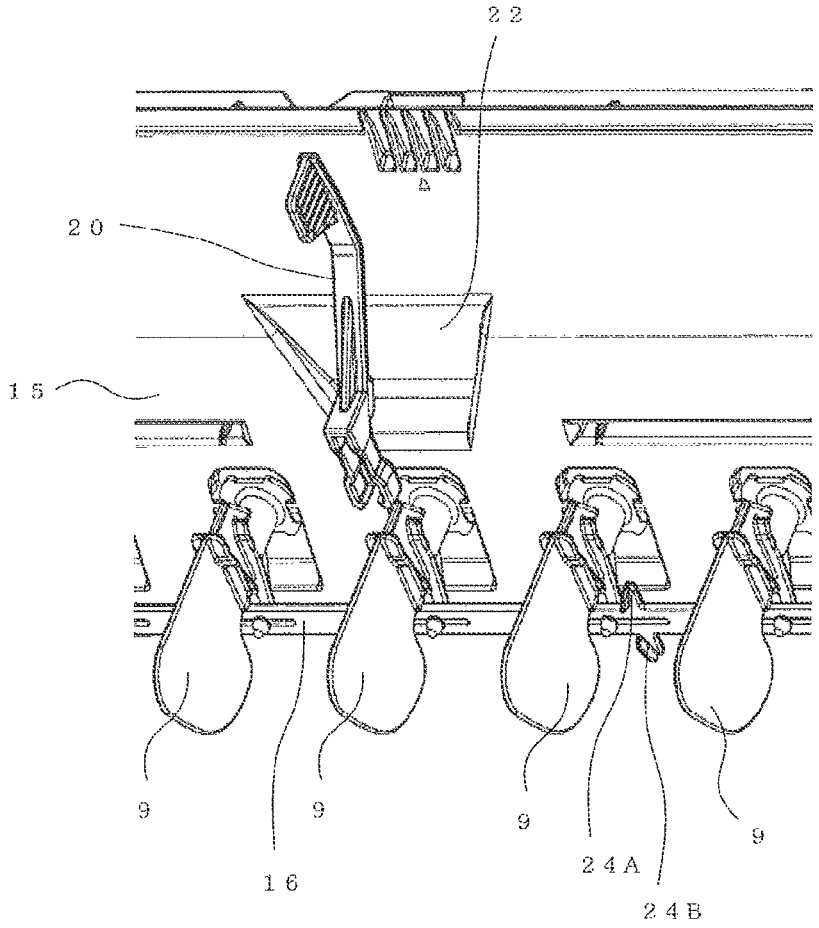
FIG. 8 schematically illustrates a process of attaching the manual operation member to the air flow direction adjusting member to which the link plate shown in FIG. 7 is attached.

The air flow direction adjusting members 9 (see FIG. 10) are attached to the base member 15 such that the air flow direction adjusting members 9 can freely rotate. Orientation of the air flow direction adjusting members 9 can be adjusted by operating the manual operation member 20 attached to the air flow direction adjusting members 9. As shown in FIG. 8, the housing 22 includes a recess that provides a clearance for attachment of the manual operating member 20 to an air flow direction adjusting member 9.

Figure 4:
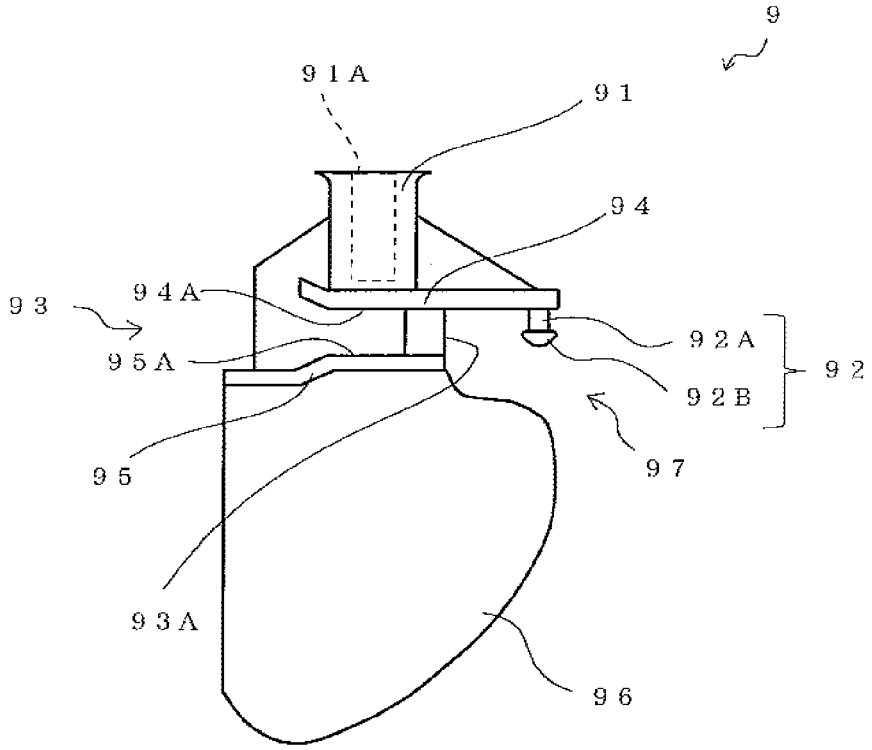
FIG. 4 is a side view illustrating the air flow direction adjusting member shown in FIG. 3.
Figure 5:
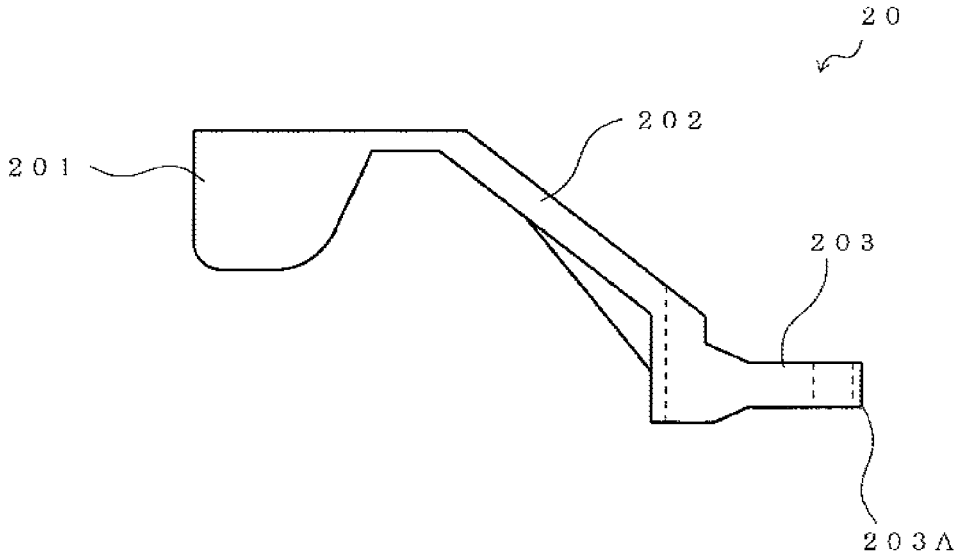
FIG. 5 is a side view illustrating a manual operation member shown in FIG. 3.

FIG. 4 is a side view illustrating the air flow direction adjusting member 9 shown in FIG. 3. FIG. 5 is a side view illustrating a manual operation member 20 shown in FIG. 3. As illustrated in FIG. 4, the air flow direction adjusting member 9 includes a rotation shaft attachment portion 91, a link plate engagement portion 92, an operation member attachment portion 93, a first base 94, a second base 95, and a plate 96, which are integrated as a single unit by using, for example, a synthetic resin. The air flow direction adjusting members 9 may be made of different materials and connected to one another.

An attachment hole 91A is formed in the rotation shaft attachment portion 91. The first base 94 includes a first guide flat plane 94A intersecting the rotation axis of the rotation shaft attachment portion 91, and the second base 95 includes a second guide flat plane 95A facing the first guide flat plane 94A. The air flow direction adjusting member 9 has a notch 97 on its outer rim. The link plate engagement portion 92 has a cylindrical portion 92A projecting from the first guide flat plane 94A toward the notch 97 and a conical portion 92B located at a tip of the cylindrical portion 92A and having a diameter larger than the outer diameter of the cylindrical portion 92A. The operation member attachment portion 93 is formed between the first guide flat plane 94A and the second guide flat plane 95A. The operation member attachment portion 93 includes a cutout vertical edge 93A of the notch 97. The width (thickness) of the operation member attachment portion 93 gradually increases from a midpoint thereof toward the cutout vertical edge 93A.

The manual operation member 20 has a handle 201 at one end and a clip 203 at the other end. The handle 201 and the clip 203 are connected to each other at a coupling portion 202 such that the handle 201 and the clip 203 are disposed at different locations with regard to height direction (i.e., vertical direction in FIG. 5) and width (lateral direction in FIG. 5). The manual operation member 20 is formed as a single unit by using a synthetic resin, for example.

The clip 203 holds the operation member attachment portion 93 illustrated in FIG. 4. The clip 203 is guided by the first guide flat plane 94A of the first base 94 and the second guide flat plane 95A facing the first guide flat plane 94A and is attached to the operation member attachment portion 93. Once the manual operation member 20 is attached to the air flow direction adjusting member 9, the clip 203 of the manual operation member 20 is supported by the first guide flat plane 94A and the second guide flat plane 95A. The clip 203 includes, at an end thereof, a nail 203A to be engaged with the cutout vertical edge 93A illustrated in FIG. 4.

Figure 6:
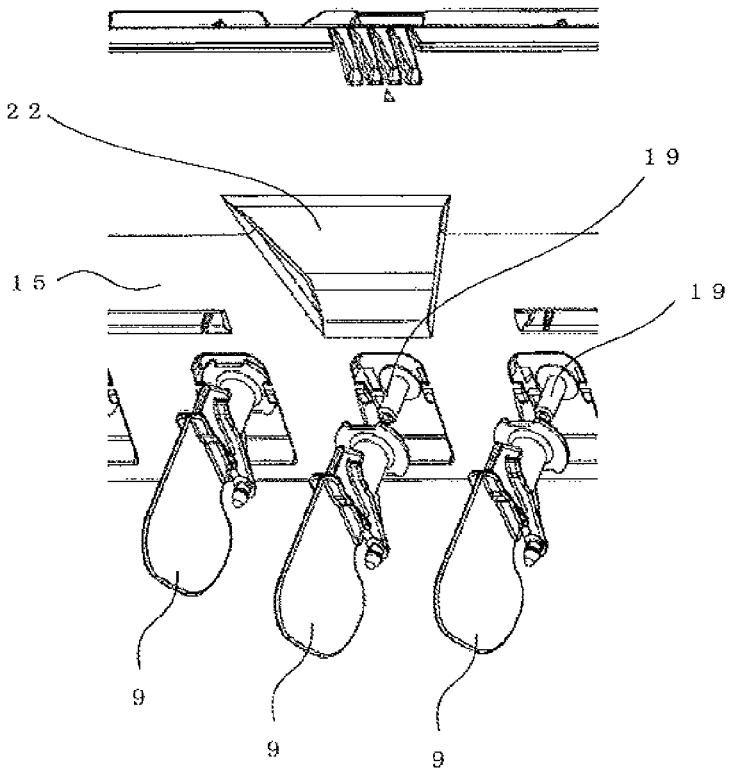
FIG. 6 schematically illustrates a process of attaching the air flow direction adjusting members to a base member shown in FIG. 3.
Figure 7:
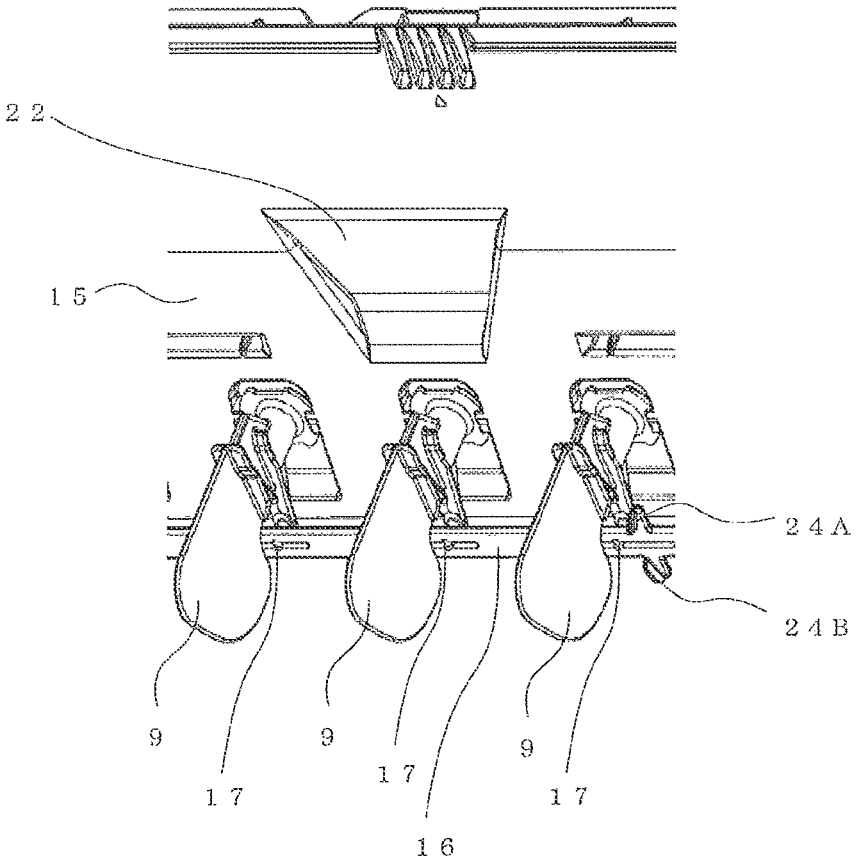
FIG. 7 schematically illustrates a process of attaching a link plate to the air flow direction adjusting members attached to the base member shown in FIG. 6.
Figure 9:
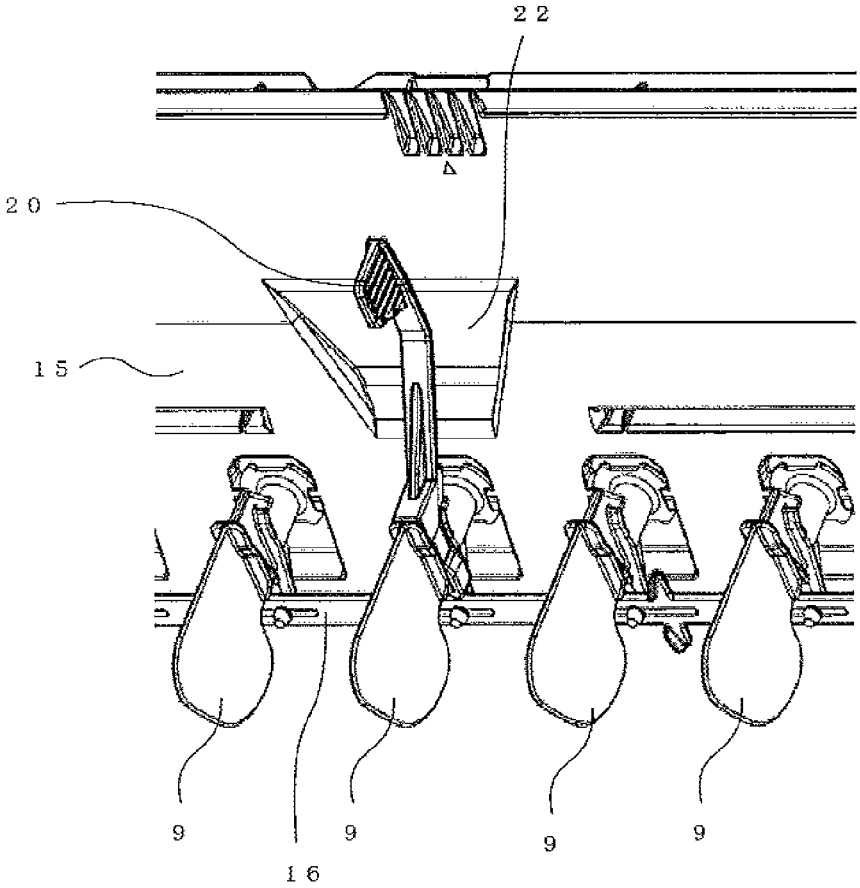
FIG. 9 schematically illustrates part of the air flow direction adjusting device assembled through the processes shown in FIGS. 6 to 8.
Figure 10:
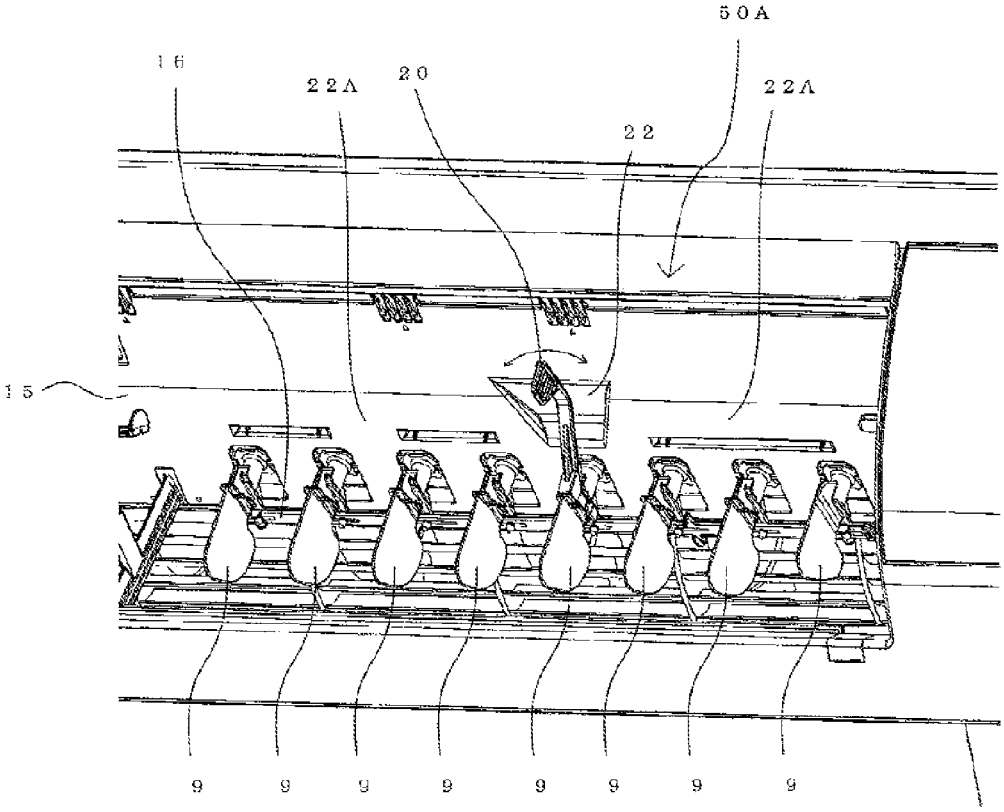
FIG. 10 schematically illustrates the entire air flow direction adjusting device shown in FIG. 9.

Referring to FIGS. 6 to 9, an example of an assembly process of the air flow direction adjusting device 50A is described. FIG. 6 schematically illustrates a process of attaching the air flow direction adjusting members 9 to the base member 15 shown in FIG. 3. FIG. 7 schematically illustrates a process of attaching the link plate 16 to the air flow direction adjusting members 9 attached to the base member 15 shown in FIG. 6. FIG. 8 schematically illustrates a process of attaching the manual operation member 20 to the air flow direction adjusting member 9 to which the link plate 16 shown in FIG. 7 is attached. FIG. 9 schematically illustrates part of the air flow direction adjusting device 50A assembled through the processes shown in FIGS. 6 to 8. FIG. 10 schematically illustrates the entire air flow direction adjusting device 50A shown in FIG. 9.

First, as illustrated in FIG. 6, the air flow direction adjusting members 9 are individually attached to the attachment shafts 19 projecting from the base member 15 toward the air passage. Specifically, the attachment shafts 19 are inserted into the attachment holes 91A (see FIG. 4) of the rotation shaft attachment portion 91, and the air flow direction adjusting members 9 are attached to the attachment shafts 19.

Next, as illustrated in FIG. 7, the link plate 16 is attached to the air flow direction adjusting members 9 attached to the attachment shafts 19. Specifically, the link plate engagement portions 92 (see FIG. 4) of the air flow direction adjusting members 9 are engaged with projection engaging holes 17 in the link plate 16.

The link plate 16 is a plate-like member used to connect the multiple air flow direction adjusting members 9 such that the air flow direction adjusting members 9 can rotate in an interlocked manner. The projection engaging holes 17 are arranged in the link plate 16 at the same interval as the attachment shafts 19. Slits are formed at both sides in the longitudinal direction of the link plate 16 of the projection engaging holes 17 so as to facilitate press fitting of the link plate engagement portion 92 into the projection engaging holes 17. The link plate 16 also includes rotation regulating projections 24A and 24B projecting outward from the outer edges of the link plate 16. Once the link plate 16 is attached to the air flow direction adjusting members 9, the rotation regulating projection 24A located to the side of the air flow direction adjusting members 9 projects toward the air flow direction adjusting members 9. The link plate 16 may be attached to the air flow direction adjusting members 9 such that the rotation regulating projection 24B located to the side of the air flow direction adjusting members 9 projects toward the air flow direction adjusting members 9. The rotation regulating projection 24A is disposed to the side of the air flow direction adjusting members 9 to which the manual operation member 20 is not attached.

The inner diameter of the projection engaging holes 17 is larger than the outer diameter of the cylindrical portion 92A of the link plate engagement portion 92 illustrated in FIG. 4 and is smaller than the outer diameter of the bottom surface of the conical portion 92B of each of the air flow direction adjusting members 9. Thus, when the cylindrical portions 92A of the link plate engagement portions 92 are press fitted into the projection engaging holes 17, the bottom surfaces of the conical portions 92B are locked at the perimeters of the projection engaging holes 17, and thus, the link plate engagement portions 92 are not detached from the projection engaging holes 17.

Referring to FIG. 8, the manual operation member 20 is attached to the air flow direction adjusting members 9 connected to one another by the link plate 16. The clip 203 of the manual operation member 20 is housed in the housing 22 formed as a recess, and the manual operation member 20 is attached only to one of the air flow direction adjusting member 9 at the location corresponding to the housing 22. Portions of the base member 15, except a portion where the housing 22 is formed, serve as attachment-inhibiting portions 22A that inhibit attachment of the manual operation member 20. Specifically, at locations corresponding to the air flow direction adjusting members 9 to which the manual operation member 20 is not attached, the attachment-inhibiting portions 22A inhibit attachment of the manual operation member 20. A projecting attachment-inhibiting portion may be provided in the housing formed as a flat plane.

As described above, the base member 15, the air flow direction adjusting members 9, the link plate 16, and the manual operation member 20 are assembled to form the air flow direction adjusting device 50A, as illustrated in FIGS. 9 and 10. Lateral operation of the manual operation member 20 causes the air flow direction adjusting member 9 to which the manual operation member 20 is attached and the air flow direction adjusting members 9 connected to one another by the link plate 16 to rotate in an interlocked manner.

Figure 11:
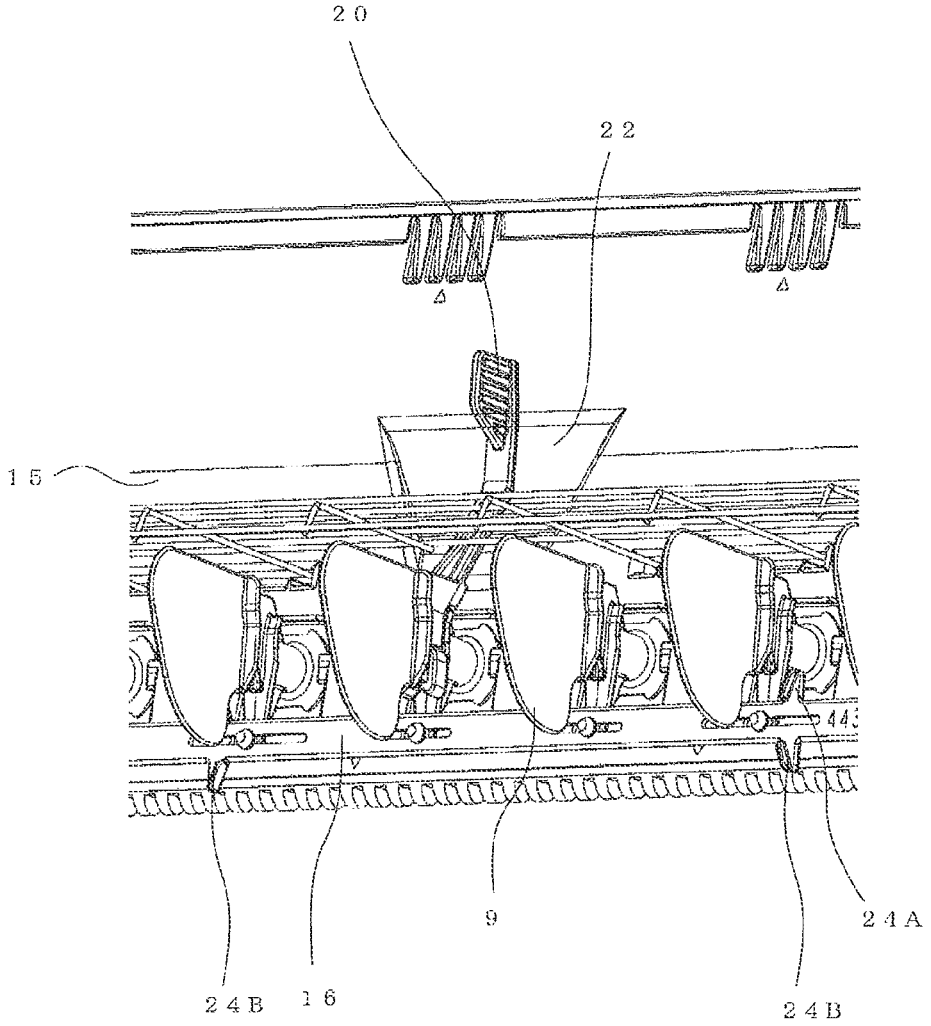
FIG. 11 schematically illustrates a center blowoff state of the air flow direction adjusting device.
Figure 12:
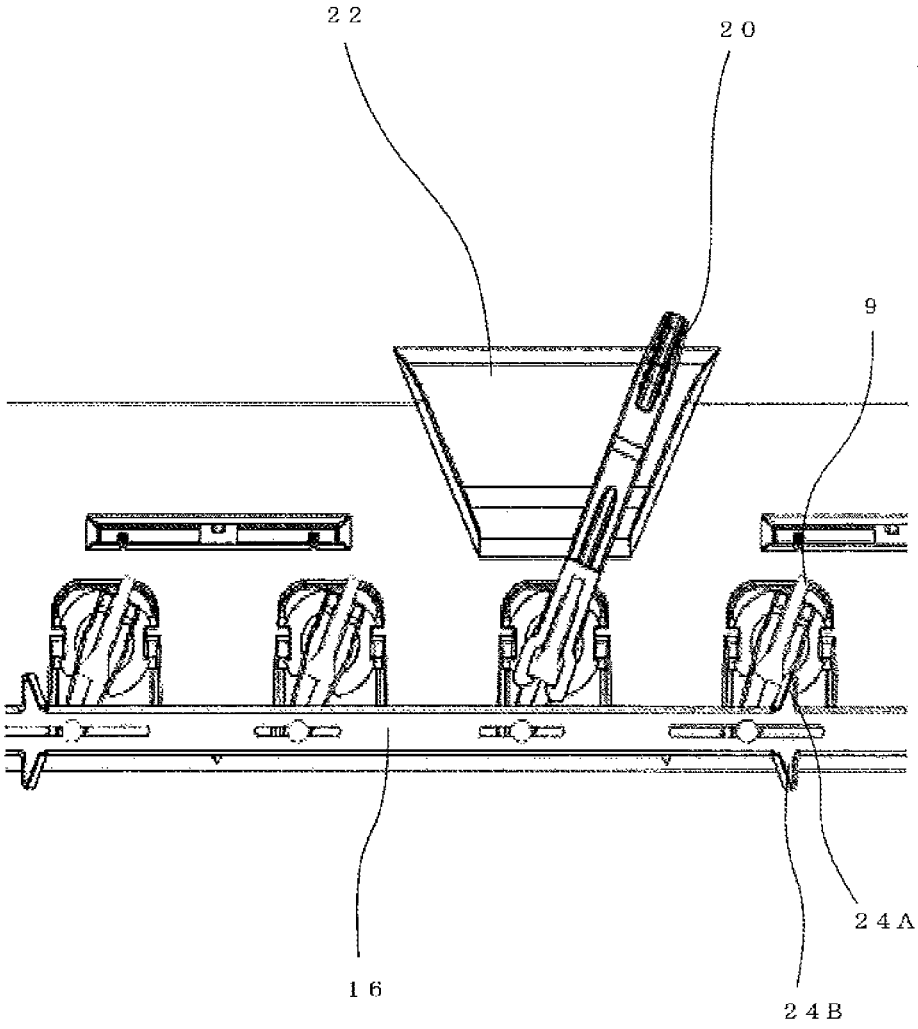
FIG. 12 schematically illustrates a right blowoff state of the air flow direction adjusting device.

An example of operation of the manual operation member 20 is described. FIG. 11 schematically illustrates a center blowoff state of the air flow direction adjusting device 50A. FIG. 12 schematically illustrates a right blowoff state of the air flow direction adjusting device 50A.

In the center blowoff state of the air flow direction adjusting device 50A illustrated in FIG. 11, a user operates the manual operation member 20 to the right so that the air flow direction adjusting device 50A is adjusted to the right blowoff state, as illustrated in FIG. 11. In the center blowoff state illustrated in FIG. 10, a gap is formed between the air flow direction adjusting members 9 and the rotation regulating projection 24A, and the direction of air flow can be laterally adjusted. As illustrated in FIG. 11, when a lateral blowoff angle (a right blowoff angle) reaches its rotation limit amount, the rotation regulating projection 24A comes into contact with the cutout vertical edges 93A of the air flow direction adjusting members 9 so that clockwise rotation of the air flow direction adjusting members 9 is restricted. The rotation regulating projection 24A is formed at the left of at least one of the air flow direction adjusting members 9 so that counterclockwise rotation of the air flow direction adjusting members 9 is restricted.

As described above, in the air flow direction adjusting device 50A of Embodiment 1, the air flow direction adjusting members 9 are commonalized. Thus, the manufacturing process and the assembly process are simplified, and the burden placed on managing components is reduced.

In addition, in Embodiment 1, the manual operation member 20 is attached to the air flow direction adjusting member 9 while being housed in the housing 22. Thus, the attachment location of the manual operation member 20 is clearly determined. Further, at locations corresponding to the air flow direction adjusting members 9 to which the manual operation member 20 is not attached, the attachment-inhibiting portions 22A inhibit attachment of the manual operation member 20, thereby ensuring attachment of the manual operation member 20 to a desired location.

Moreover, in Embodiment 1, the link plate engagement portions 92 to which the link plate 16 is to be engaged are provided at the inner side of the notches 97 formed in the air flow direction adjusting members 9, and the link plate 16 is disposed at the inner side of the notches 97. The cutout vertical edge 93A of the operation member attachment portion 93 to which the manual operation member 20 is fixed is formed at the inner side of the notch 97. At the inner side of the notch 97, a mechanism composed of the cutout vertical edge 93A and the rotation regulating projection 24A on the link plate 16 and defining the rotation limit amount of the air flow direction adjusting members 9 is provided. In this manner, in Embodiment 1, the above-described configuration is obtained by using the notches 97 formed in the air flow direction adjusting members 9. Thus, the limited space of air passage of the indoor unit 100 can be efficiently utilized.

Embodiment 1 is not limited to the examples described above. For example, in the foregoing description, the link plate 16 is attached to the air flow direction adjusting members 9 and then the manual operation member 20 is attached to one of the air flow direction adjusting members 9. Alternatively, the air flow direction adjusting member 9 to which the manual operation member 20 is attached may be attached to the base member 15 before attachment of the link plate 16.

In the foregoing description, two air flow direction adjusting devices 50 (50A and 50B) are disposed at the air outlet 4 of the indoor unit 100. Alternatively, one or three or more air flow direction adjusting devices 50 may be provided.

Embodiment 2

Embodiment 1 provides an example in which the manual operation member 20 attached to the air flow direction adjusting member 9 is operated so as to rotate the air flow direction adjusting members 9. Compared with Embodiment 1, in an air flow direction adjusting device 50C according to Embodiment 2, no manual operation member 20 is provided, and air flow direction adjusting members 9 connected to one another by a link plate 16 automatically rotate by means of a driving mechanism (driving means) 40. In the foregoing description, description of components already described in Embodiment 1 is not repeated.

Figure 13:
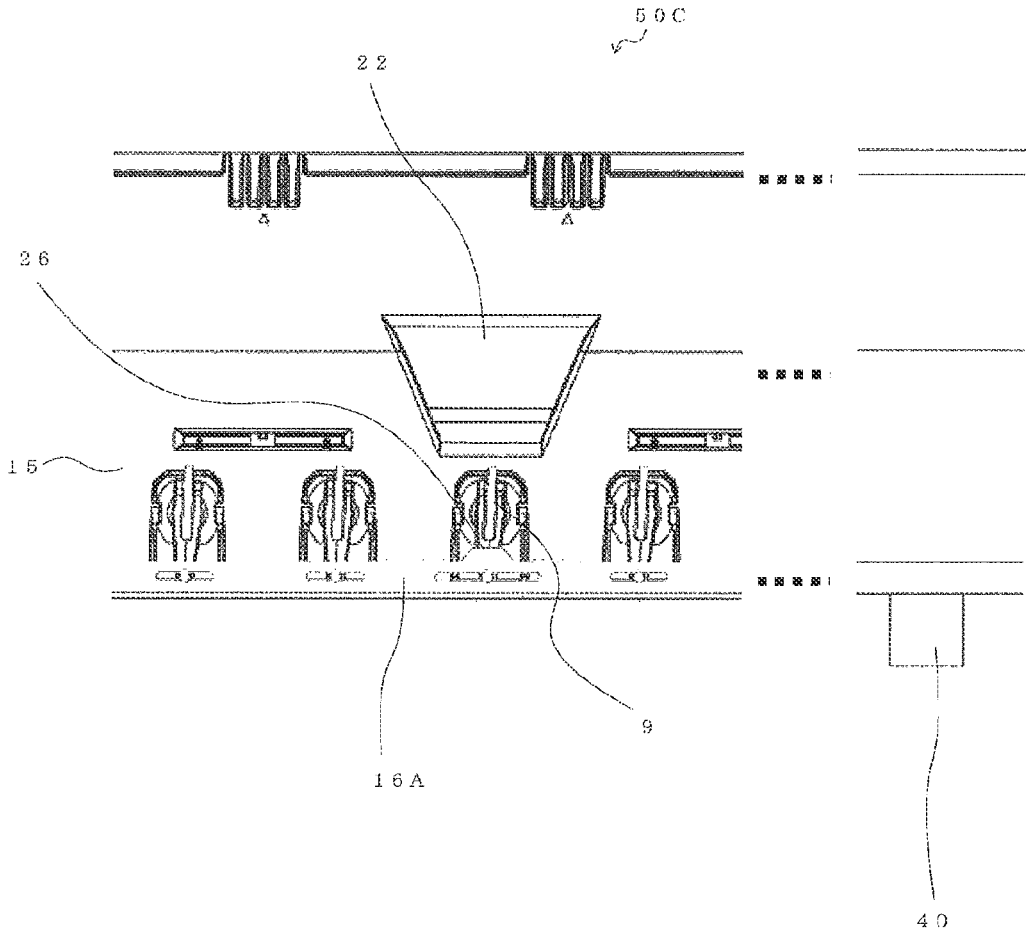
FIG. 13 schematically illustrates part of an air flow direction adjusting device according to Embodiment 2.

FIG. 13 schematically illustrates part of the air flow direction adjusting device 50C of Embodiment 2. In Embodiment 2, the driving mechanism 40, not shown, is connected in the longitudinal direction to at least one end of a link plate 16A. The driving mechanism 40 adjusts orientation of the air flow direction adjusting members 9 attached to the link plate 16A by moving the link plate 16A in a substantially longitudinal direction.

As illustrated in FIG. 13, the link plate 16A of Embodiment 2 includes an attachment inhibiting projection 26 located at a position corresponding to a housing 22 and projecting toward the air flow direction adjusting members 9. The attachment inhibiting projection 26 inhibits attachment of a manual operation member 20. When the manual operation member 20 is to be attached to the air flow direction adjusting member 9 while being housed in the housing 22, an end of a clip 203 of the manual operation member 20 comes into contact with the attachment inhibiting projection 26 so that attachment of the manual operation member 20 to the air flow direction adjusting member 9 is inhibited.

As described above, in Embodiment 2, the automatic air flow direction adjusting device 50C can be obtained only by replacing the link plate 16 of Embodiment 1 with the link plate 16A. Thus, the components can be commonalized between the automatic air flow direction adjusting device and the manual air flow direction adjusting device.

The present invention is not limited to Embodiments described above and can be variously modified within the scope of the invention. Specifically, the configuration of Embodiments may be appropriately modified, and at least part of the configurations may be replaced by other configurations. In addition, components whose locations are not specifically described are not limited to the locations described in Embodiments, and may be disposed at any location at which the functions thereof are obtained.

For example, the air flow direction adjusting device 50A of Embodiment 1 may include driving means for automatically rotating the air flow direction adjusting members 9 in addition to the manual operation member 20. That is, in this case, the driving means is connected to the link plate of Embodiment 1, and the driving means adjusts orientation of the air flow direction adjusting members 9 attached to the link plate by moving the link plate.

REFERENCE SIGNS LIST

1: front casing, 1A: air inlet, 2: front design panel, 3: rear casing, 3A: storage space, 4: air outlet, 5: vertical air flow direction adjusting device, 6: filter, 7: heat exchanger, 8: fan, 9: air flow direction adjusting member, 10: drain pan, 12: heat insulator, 13: drain hose, 14: pipe, 15: base member, 16: link plate, 16A: link plate, 17: projection engaging hole, 19: attachment shaft, 20: manual operation member, 22: housing, 22A: attachment-inhibiting portion, 24A: rotation regulating projection, 24B: rotation regulating projection, 26: attachment inhibiting projection, 30: protective cover, 40: driving mechanism, 50: air flow direction adjusting device, 50A: air flow direction adjusting device, 50B: air flow direction adjusting device, 50C: air flow direction adjusting device, 91: rotation shaft attachment portion, 91A: attachment hole, 92: link plate engagement portion, 92A: cylindrical portion, 92B: conical portion, 93: operation member attachment portion, 93A: cutout vertical edge, 94: first base, 94A: first guide flat plane, 95: second base, 95A: second guide flat plane, 96: plate, 97: notch, 100: indoor unit, 201: handle, 202: coupling portion, 203: clip, 203A: nail

The invention claimed is:

1. An air flow direction adjusting device of an air-conditioning apparatus, the air flow direction adjusting device comprising:

a base member including a plurality of attachment shafts projecting from an air passage surface forming an air passage of the air-conditioning apparatus;

a plurality of air flow direction adjusting members individually attached to the attachment shafts such that the plurality of air flow direction adjusting members are allowed to rotate; and a link plate configured to connect the plurality of air flow direction adjusting members to one another such that the plurality of air flow direction adjusting members rotate in an interlocked manner, wherein each of the plurality of air flow direction adjusting members includes a rotation shaft attachment portion attached to a corresponding one of the attachment shafts, a link plate engagement portion engaged with the link plate, and an operation member attachment portion to which a manual operation member for manually adjusting orientation of the air flow direction adjusting members is attachable, and the base member includes a housing comprising a recess disposed at a location corresponding to one of the air flow direction adjusting members to which the manual operation member is attached, the recess configured to provide clearance for the manual operating member when the manual operating member is attached to the one of the plurality of air flow direction adjusting members and configured to house the manual operation member, and an attachment-inhibiting portion that is located at a location corresponding to another one of the plurality of air flow direction adjusting members to which the manual operation member is not attached and that hinders attachment of the manual operation member.

2. The air flow direction adjusting device of the air-conditioning apparatus of claim 1, wherein the manual operation member includes a handle at an end and a clip holding the operation member attachment portion at the other end, and the housing houses the handle of the manual operation member.

3. The air flow direction adjusting device of the air-conditioning apparatus of claim 1, further comprising a driving unit configured to move the link plate, wherein the link plate includes an attachment inhibiting projection that is located at a location corresponding to the housing and inhibits attachment of the manual operation member to one of the air flow direction adjusting members.

4. The air flow direction adjusting device of the air-conditioning apparatus of claim 1, wherein the link plate includes a rotation regulating projection that is located to a side of one of the air flow direction adjusting members and projects toward the air flow direction adjusting members, and when the one of the air flow direction adjusting members rotates to a rotation limit amount, the rotation regulating projection comes into contact with the one of the air flow direction adjusting members.

5. The air flow direction adjusting device of the air-conditioning apparatus of claim 1, wherein each of the plurality of air flow direction adjusting members further includes a first guide flat plane extending in a direction intersecting a rotation axis of the rotation shaft and a second guide flat plane facing the first guide flat plane, and when being attached to one of the air flow direction adjusting members, the manual operation member is supported by the first guide flat plane and the second guide flat plane.

6. The air flow direction adjusting device of the air-conditioning apparatus of claim 5, wherein each of the air flow direction adjusting members has a notch at an outer edge, the link plate engagement portion includes a cylindrical portion projecting from the first guide flat plane toward the notch and a conical portion located at a tip of the cylindrical portion and having a diameter larger than an outer diameter of the cylindrical portion, and the manual operation member is engaged with an engagement portion located at an edge of the notch between the first guide flat plane and the second guide flat plane.

7. An air-conditioning apparatus comprising an air flow direction adjusting device of the air-conditioning apparatus, the air flow direction adjusting device including:

a base member including a plurality of attachment shafts projecting from an air passage surface forming an air passage of the air-conditioning apparatus;

a plurality of air flow direction adjusting members individually attached to the attachment shafts such that the plurality of air flow direction adjusting members are allowed to rotate; and a link plate configured to connect the plurality of air flow direction adjusting members to one another such that the plurality of air flow direction adjusting members rotate in an interlocked manner, wherein each of the plurality of air flow direction adjusting members includes a rotation shaft attachment portion attached to a corresponding one of the attachment shafts, a link plate engagement portion engaged with the link plate, and an operation member attachment portion to which a manual operation member for manually adjusting orientation of the air flow direction adjusting members is attachable, and the base member includes a housing comprising a recess disposed at a location corresponding to one of the air flow direction adjusting members to which the manual operation member is attached, the recess configured to provide clearance for the manual operating member when the manual operating member is attached to the one of the plurality of air flow direction adjusting members and configured to house the manual operation member, and an attachment-inhibiting portion that is located at a location corresponding to another one of the plurality of air flow direction adjusting members to which the manual operation member is not attached and that hinders attachment of the manual operation member.

* * * * *